US009553372B2

(12) United States Patent
Krapf et al.

(10) Patent No.: US 9,553,372 B2
(45) Date of Patent: Jan. 24, 2017

(54) ELECTRIC DEVICE

(75) Inventors: Reiner Krapf, Filderstadt (DE); Heiko Braun, Leinfelden-Echterdingen (DE); Tobias Zibold, Stuttgart (DE); Christoph Wieland, Stuttgart-Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 821 days.

(21) Appl. No.: 13/061,030

(22) PCT Filed: Aug. 20, 2009

(86) PCT No.: PCT/EP2009/060759

§ 371 (c)(1),
(2), (4) Date: Apr. 15, 2011

(87) PCT Pub. No.: WO2010/023152

PCT Pub. Date: Mar. 4, 2010

(65) Prior Publication Data

US 2011/0181483 A1 Jul. 28, 2011

(30) Foreign Application Priority Data

Aug. 28, 2008 (DE) ..... 10 2008 041 651

(51) Int. Cl.

| | |
|---|---|
| ***H01Q 21/26*** | (2006.01) |
| ***H01Q 1/38*** | (2006.01) |
| ***H01Q 21/24*** | (2006.01) |
| ***H01Q 7/00*** | (2006.01) |

(52) U.S. Cl.

CPC ..... *H01Q 21/24* (2013.01); *H01Q 7/00* (2013.01)

(58) Field of Classification Search

CPC ..... G01S 13/86; H01Q 1/22; H01Q 7/00; H01Q 1/928; H01Q 21/24; H01Q 21/26; G01V 3/00; G01V 3/10; G01V 3/15; G01V 3/104

USPC ..... 343/700 MS

See application file for complete search history.

(56) References Cited

U.S. PATENT DOCUMENTS

| | | | | |
|---|---|---|---|---|
| 5,874,924 | A * | 2/1999 | Csongor | H01Q 1/288 343/789 |
| 5,942,899 | A * | 8/1999 | Shrekenhamer | G01V 3/12 324/326 |
| 8,269,479 | B2 * | 9/2012 | Krapf et al. | 324/67 |
| 2001/0033607 | A1 | 10/2001 | Fleming et al. | |

(Continued)

FOREIGN PATENT DOCUMENTS

| | | |
|---|---|---|
| DE | 10 2004 032 175 | 1/2006 |
| DE | 10 2005 052 367 | 5/2007 |

(Continued)

OTHER PUBLICATIONS

International Search Report corresponding to PCT Application No. PCT/EP2009/060759, mailed Oct. 9, 2009 (German and English language document) (9 pages).

*Primary Examiner* — Laura Gudorf

(74) *Attorney, Agent, or Firm* — Maginot, Moore & Beck LLP

(57) ABSTRACT

A locating device includes an LCR antenna apparatus which has an antenna unit having a first polarization direction and is configured to transmit and/or receive a measurement signal having the first polarization direction. The antenna unit has at least one second polarization direction for transmitting and/or receiving the measurement signal.

14 Claims, 5 Drawing Sheets

(56) References Cited

U.S. PATENT DOCUMENTS

| | | | | |
|---|---|---|---|---|
| 2003/0011525 | A1 | 1/2003 | Sanad | |
| 2008/0036644 | A1* | 2/2008 | Skultety-Betz et al. | 342/22 |
| 2008/0062062 | A1* | 3/2008 | Borau | H01Q 1/246 343/844 |
| 2008/0231525 | A1* | 9/2008 | Krapf et al. | 343/720 |
| 2008/0258975 | A1* | 10/2008 | Schmidt et al. | 343/700 MS |

FOREIGN PATENT DOCUMENTS

| | | | |
|---|---|---|---|
| DE | 10 2005 062 874 | | 7/2007 |
| EP | 0 115 270 | | 8/1984 |
| WO | WO 2006003059 | A1 * | 1/2006 |
| WO | WO 2007020128 | A1 * | 2/2007 |
| WO | 2007/051721 | A1 | 5/2007 |

* cited by examiner

ELECTRIC DEVICE

This application is a 35 U.S.C. §371 National Stage Application of PCT/EP2009/060759, filed Aug. 20, 2009, which claims the benefit of priority to Serial No. 10 2008 041 651.7, filed Aug. 28, 2008 in Germany, the disclosures of which are incorporated herein by reference in their entirety.

The disclosure relates to an electric device, and in particular, a locating device having an LCR antenna.

BACKGROUND

An electric device, in particular a locating device, having an LCR antenna apparatus which has an antenna unit having a first polarization direction and is intended to transmit and/or receive a measurement signal having the first polarization direction is already known.

SUMMARY

The disclosure is based on an electric device, in particular a locating device, having an LCR antenna apparatus which has an antenna unit having a first polarization direction and is intended to transmit and/or receive a measurement signal having the first polarization direction.

It is proposed for the antenna unit to have at least one second polarization direction for transmitting and/or receiving the measurement signal. In this context, the term "intended" should be understood as meaning, in particular, specially equipped and/or specially designed. Furthermore, an "LCR antenna apparatus (Large-Current-Radiator antenna apparatus)" should be understood as meaning, in particular, an antenna apparatus having an emission element through which a large current flows during operation. The antenna unit is preferably oriented such that it is symmetrical to a plane of symmetry, the plane of symmetry being oriented perpendicular to the emission element. The antenna unit is advantageously at least partially formed from corrosion-resistant sheet metal, in particular from bent sheet metal, for example sheet metal made of stainless steel and/or a galvanized sheet and/or a gold-plated sheet, etc. Alternatively, it is conceivable to form the antenna unit as a plastic body, in which case surfaces and/or sections are at least partially metallized, in particular in order to conduct signals, and a specific dielectric constant of the plastic body needs to be taken into account when designing and/or calculating the antenna unit. In this case, a "measurement signal" should be understood as meaning, in particular, an electromagnetic signal which is preferably formed from a broadband signal, in particular from an ultra wide band signal (UWB signal), the ultra wide band signal having a useful frequency range with a center frequency in the frequency range of 1 GHz to 15 GHz and a frequency bandwidth of at least 500 MHz. In a particularly advantageous manner, the ultra wide band signal has a spectral power density of at most −41.3 dBm/MHz. In this case, signals or electromagnetic waves can be advantageously received at least partially independently of their polarization direction. Furthermore, the measurement signal can be transmitted independently of reception of a measurement signal by virtue of the fact that transmission can be carried out along the first polarization direction and reception can be carried out along the second polarization direction.

The electric device is preferably formed by a locating device, in particular by a handheld locating device, which is intended to locate an object arranged in an item being investigated. The received measurement signal is preferably formed by a reflection signal which is reflected by the object and/or the item being investigated.

It is also proposed for the first polarization direction to be oriented such that it is substantially orthogonal to the second polarization direction. In this case, the term "substantially orthogonal" should be understood as meaning, in particular, an orientation of the second polarization direction that is perpendicular to the first polarization direction with a maximum deviation of 20°, advantageously of at most 10° and particularly preferably of at most 1°. This refinement of the disclosure makes it possible to emit signals or waves having a different polarization direction and/or circularly and/or elliptically polarized signals or waves. In addition, linearly polarized waves may be emitted at any desired angle with respect to one of the two polarization directions. This can be used with particular advantage in locating devices since electromagnetic waves are reflected only by anisotropic objects in this case and objects can thus be advantageously distinguished from a homogeneous item being investigated, for example an isotropic wall surface, or can be recognized as such.

It is also proposed for the LCR antenna apparatus to have at least two first connecting elements, which are intended to feed in a signal of the first polarization direction, and at least two further connecting elements which are intended to feed in a signal of the second polarization direction. This makes it possible to introduce different signals for the two polarization directions into the antenna unit, for example signals which are phase-shifted with respect to one another and/or signals with different amplitudes, etc. In addition, signals to be transmitted and reception signals can be supplied to the antenna element and discharged from the latter separately from one another along the two different polarization directions.

It is also proposed to apply, to one of the connecting elements for one of the polarization directions, a signal which has the same amplitude as, but is phase-shifted through 180° with respect to, a signal from the other connecting element for the polarization direction in at least one operating mode. In this case, a potential equal to zero can be advantageously achieved on a plane of symmetry between the two connecting points, the two further connecting elements for the second polarization direction being arranged in the plane of symmetry and the two polarization directions or signals of the two polarization directions thus being able to be formed independently of one another in a linear manner. In addition, circular or elliptical polarized waves can be advantageously emitted in this case using the antenna unit by simultaneously introducing signals in both polarization directions. The two polarization directions are advantageously phase-shifted or have different amplitudes for this purpose.

Another refinement of the disclosure proposes an electric device, in particular a locating device, having an LCR antenna apparatus which has a ground plane element and an antenna unit, which comprises a first polarization direction and two lower conductor elements, and is intended to transmit and/or receive a measurement signal having the first polarization direction, a distance between the two conductor elements and the ground plane element continuously increasing along a direction from a respective connecting element of the conductor elements to a region of the conductor elements which faces away from the connecting elements. In this case, a "lower conductor element" should be understood as meaning, in particular, a conductor element of the antenna unit which is, in particular, at a very short distance from the ground plane element, said distance being shorter than a very short distance of further components of the antenna unit, and has, in particular, a connecting element for supplying a signal. Furthermore, a "ground plane element" should be understood as meaning, in particular, an element which is arranged substantially parallel to an emission element of the antenna unit and is preferably arranged in a region beside the antenna unit for the purpose of shielding signals and/or waves and/or particularly advantageously for the purpose of reflecting signals and/or waves in a desired emission direction, which signals and/or waves are emitted by the antenna unit in an undesirable direction, in particular in the direction of the ground plane element. In this case, a continuous transition from a low characteristic impedance, for example a characteristic impedance of 50Ω in the case of components and lines of radio-frequency circuits, to a high characteristic impedance, for example a characteristic impedance of 377Ω for an emission space of the antenna unit, may be advantageously at least partially effected. In addition, abrupt steps in the lower conductors may be avoided in this case and, in association with this, reflections of an electromagnetic wave in the antenna unit can be at least reduced or prevented.

The lower conductor element is preferably used to conduct signals or waves from the connecting elements to lateral conductor elements of the antenna unit and to conduct signals or waves from said lateral conductor elements to the emission element of the antenna unit during operation of the electric device.

A particularly advantageous continuous transition from the low characteristic impedance to the high characteristic impedance can be achieved if the two lower conductor elements have a width which increases along the direction. In this case, the lower conductor elements are preferably symmetrical, in particular trapezoidal.

One advantageous development of the disclosure proposes an electric device, in particular a locating device, having an LCR antenna apparatus which has an antenna unit having a first polarization direction and is intended to transmit and/or receive a measurement signal having the first polarization direction, the LCR antenna apparatus having a sheath which surrounds the antenna unit in at least one direction and forms a cavity around the antenna unit. The sheath preferably surrounds the antenna unit along a circumferential direction of an emission element, the sheath preferably being arranged around the antenna unit at a distance from the latter, with the result that the cavity or a clearance is formed between the antenna unit and the sheath, in which cavity or clearance signals and/or waves can be advantageously deflected in a desired direction, in particular. Emission in undesirable directions can be at least partially prevented and emission, in particular perpendicular to a measuring surface or an emission element, and, in association with this, efficiency of the LCR antenna apparatus can be advantageously increased on account of the fact that the waves are deflected in a desired direction. This can be achieved in a particularly advantageous manner if the sheath is at least partially formed from a conductive material. In this case, the sheath may be formed from a metal and/or from a plastic body having a metal coating and/or from a conductive plastics material having metal-like properties, for example.

It is also proposed for the sheath to have at least one induction coil, thus making it possible to dispense with additional metal and/or conductive components and/or elements of the sheath. In addition, the induction coil can be used as an inductive sensor, with the result that, in addition to detection using the antenna unit, objects, in particular metal objects, can be advantageously detected in the item being investigated.

It is also proposed for the sheath to have a shape which is oriented such that it is symmetrical to at least one plane of symmetry of the antenna unit, thus advantageously making it possible to prevent a negative influence on signal emission and/or reception of a signal along the polarization direction of the antenna unit. The antenna unit preferably has two planes of symmetry, the sheath being arranged, in particular, in a rotationally symmetrical manner with respect to the two planes of symmetry. For example, in the case of an antenna unit having two polarization directions oriented such that they are orthogonal to one another, the sheath may have an octagonal cross section, thus enabling particularly space-saving assembly of the LCR antenna apparatus.

Another embodiment of the disclosure proposes an electric device, in particular a locating device, having an LCR antenna apparatus which has an antenna unit having a first polarization direction and is intended to transmit and/or receive a measurement signal having the first polarization direction, the LCR antenna apparatus having a retaining element which is intended to fix the antenna unit, in particular in the electric device. In this case, positioning of the antenna unit may be retained without change, a position or a position parameter of the antenna unit being able to be used for calibration and/or isolation between two polarization directions, in particular. The retaining element is preferably formed from a plastic, with the result that a polarization direction of the antenna unit remains substantially unaffected by the retaining element. The retaining element is advantageously screwed to a housing of the electric device and is fastened to the antenna unit using plastic pins. Alternatively, the retaining element may be adhesively bonded, clamped, etc. to the antenna unit. The retaining element is preferably fastened to the antenna unit in a region and/or at a position of the antenna unit which preferably slightly contribute(s) to radio-frequency emission, in particular, for example in regions with little current flow.

It is also proposed for the electric device to have a guide unit with a direction of movement, the retaining element arranging the antenna unit at an angle of a plane of symmetry of the antenna unit of approximately 45° with respect to the direction of movement. In this context, a "guide unit" should be understood as meaning, in particular, a unit which is intended to guide the locating device on a surface of the item being investigated or at a distance from the surface of the item being investigated. The locating device is preferably guided in a plane parallel to the surface of the item being investigated. Furthermore, a "direction of movement" should be understood as meaning, in particular, a direction along which the locating device is preferably moved on or parallel to a surface of the item being investigated, in particular by an operator of the locating device. In this case, the direction of movement may be dependent on a rolling direction of rolling bodies of the guide unit and/or on a preferred, in particular horizontal, hand movement direction which is preferably oriented perpendicular to gravity and/or parallel to a floor area. This refinement advantageously makes it possible to achieve an orientation of one or more planes of symmetry and/or polarization directions of approximately 45° with respect to an object to be detected and thus makes it possible to advantageously separate the transmission signal and reception signal. In this case, the transmission signal can be emitted along a first polarization direction and a polarization direction oriented such that it is orthogonal to the first polarization direction can be used to receive a signal reflected by the object, the emitted signal undergoing polarization rotation during reflection in this case.

In a particularly advantageous manner, it is possible to dispense with further components and assembly complexity if the retaining element is intended to accommodate a sheath of the antenna unit.

It is also proposed for the retaining element to have recesses which are intended to guide connecting elements of the antenna unit. In this case, it is possible to assemble the LCR antenna apparatus in a structurally simple manner, to be precise by virtue of the fact that the connecting elements can be guided through the recesses and can then be soldered on a printed circuit board.

BRIEF DESCRIPTION OF THE DRAWING

Further advantages emerge from the following description of the drawing. The drawing illustrates exemplary embodiments of the disclosure. The drawing, the description and the claims contain numerous features in combination. A person skilled in the art will also expediently consider the features individually and will combine them to form further expedient combinations.

In the drawing.

DETAILED DESCRIPTION

Figure 1:
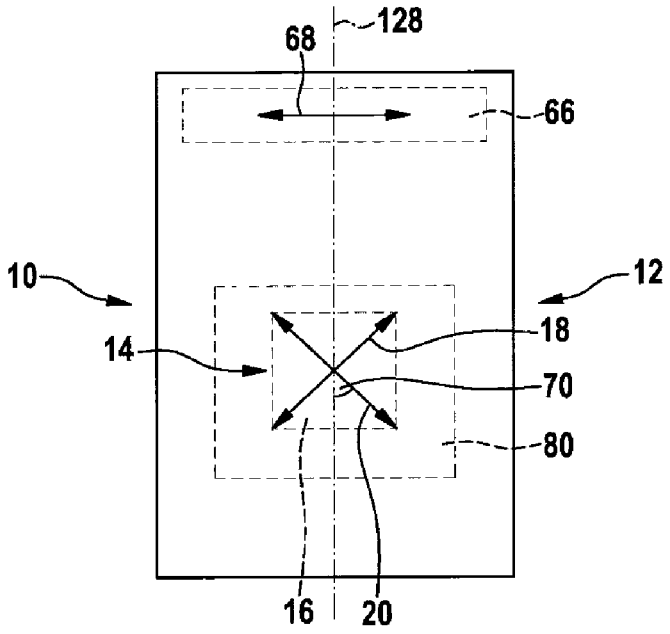
FIG. 1 shows a diagrammatic illustration of a locating device according to the disclosure having an LCR antenna apparatus.
Figure 2:
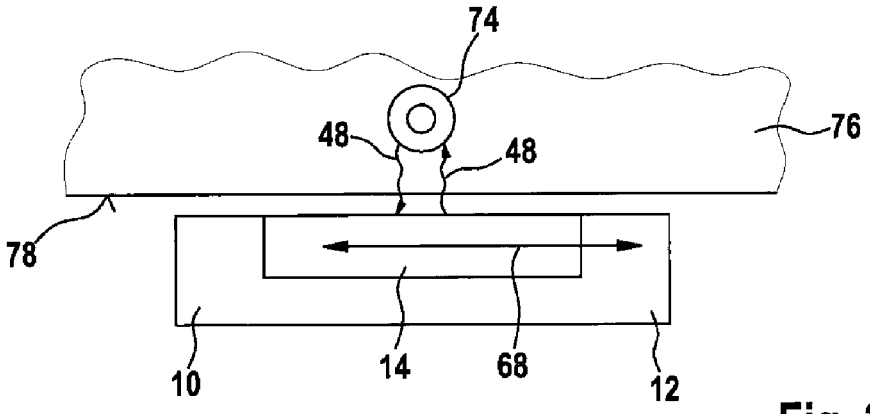
FIG. 2 shows a diagrammatic view of the locating device together with an item being investigated.

FIG. 1 illustrates an electric device 10 formed by a handheld locating device 12. The locating device 12 is intended to locate or detect objects 74, for example lines etc., in an item being investigated 76, for example a wall (FIG. 2). For this purpose, the locating device 12 can be moved by an operator over a surface 78 of the item being investigated 76, for example a wall surface, along a preferred direction of movement 68. For this purpose, the locating device 12 has a guide unit 66 which can be used by an operator to move the locating device 12 on the surface 78. The preferred direction of movement 68 is oriented substantially perpendicular to a weight force acting on the locating device 12 and corresponds substantially to a pivoting movement of an arm of the operator. The locating device 12 has a locating unit 80 which is intended to transmit and receive a measurement signal 48. In this case, the measurement signal 48 is formed by an ultra wide band signal. The ultra wide band signal is generated by the locating unit 80, which has a signal generating unit (not illustrated in any more detail) for this purpose, and is emitted via an LCR antenna apparatus 14 of the locating device 12. In addition to emitting the measurement signal 48 or the ultra wide band signal, the LCR antenna apparatus 14 is intended to receive the ultra wide band signal reflected by the item being investigated and/or by the object 74. For this purpose, the LCR antenna apparatus 14 has an antenna unit 16 having a first polarization direction 18 for transmitting and/or receiving a measurement signal 48. The antenna unit 16 also has a second polarization direction 20 for transmitting and/or receiving the measurement signal 48.

Figure 3:
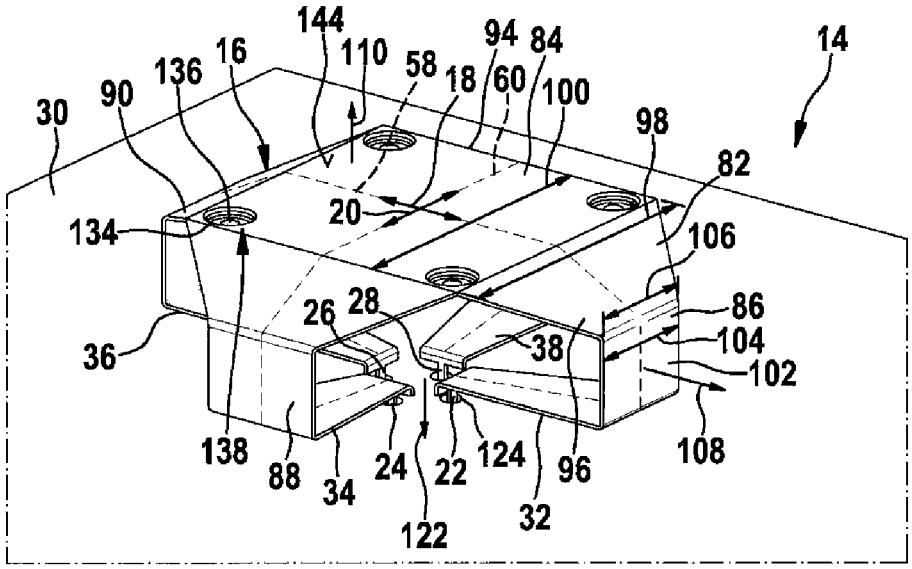
FIG. 3 shows a diagrammatic illustration of the LCR antenna apparatus having an antenna unit.

The antenna unit 16 is formed in one part and is formed by a bent sheet metal component 82 (FIG. 3). A thickness of the sheet metal component 82 is preferably designed such that an undesirable skin effect, which reduces an emission property of the antenna unit 16, is prevented. The antenna unit 16 also has an emission element 84, four lateral conductor elements 86, 88, 90, and four lower conductor elements 32, 34, 36, 38 each with a connecting element 22, 24, 26, 28. The emission element 84 is square with four sides 94 of equal size and is symmetrical with respect to two planes of symmetry 58, 60 which are oriented perpendicular to the emission element 84 and perpendicular to one another. One of the four lateral conductor elements 86, 88, 90, 92 adjoins one of the four sides 94 of equal size in a symmetrical manner, which conductor elements each have a first partial area element 96 which is trapezoidal and is arranged in an inclined manner with respect to the emission element 84. The trapezoidal first partial area elements 96 extend away from the emission element 84 in a tapering fashion, a side length 100 of the emission element corresponding to a long baseline length 98 of the trapezoidal first partial area elements 96. The lateral conductor elements 86, 88, 90, 92 also have a second, rectangular partial area element 102 which adjoins the first, trapezoidal partial area element 96 of the lateral conductor elements 86, 88, 90, 92. A width 104 of the second, rectangular partial area elements 102 corresponds in this case to a short baseline length 106 of the trapezoidal first partial area elements 96. The second, rectangular partial area elements 102 are arranged on a side of the first trapezoidal partial area elements 96 which faces away from the emission element 84. In addition, a surface normal vector 108 of the second, rectangular partial area elements 102 is oriented substantially perpendicular to a surface normal vector 110 of the emission element 84.

Figure 4:
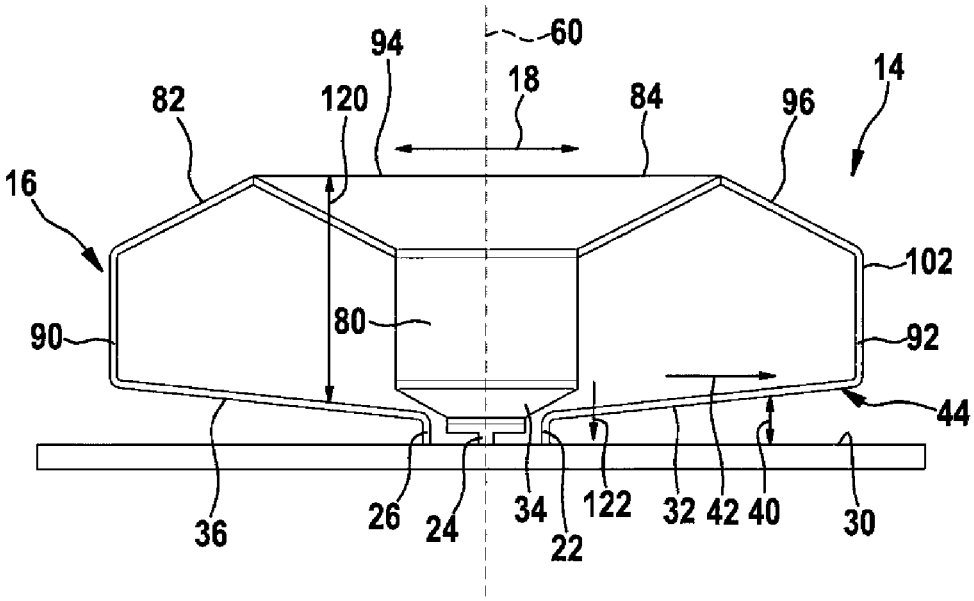
FIG. 4 shows a side view of the antenna unit from FIG. 3.
Figure 5:
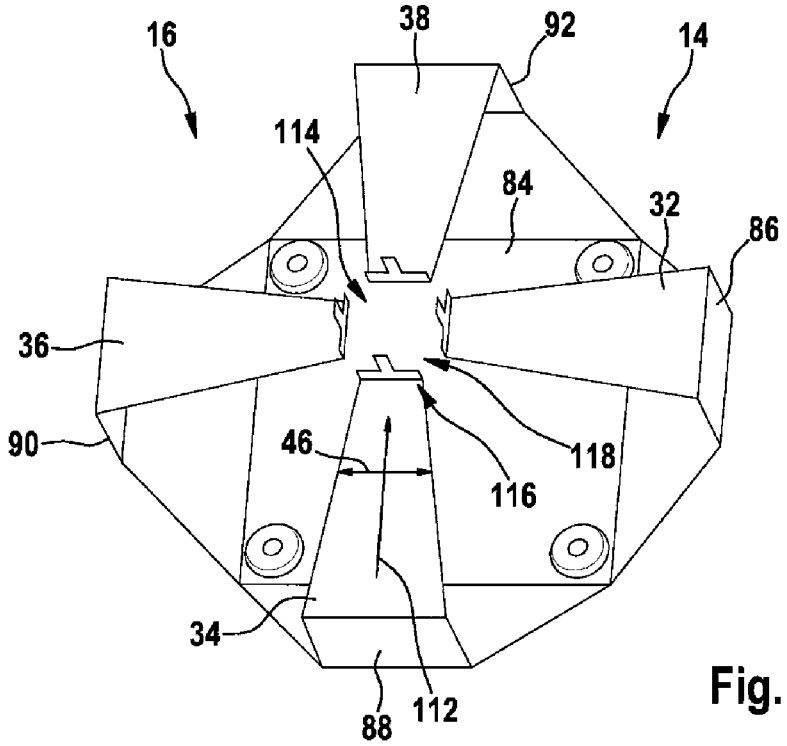
FIG. 5 shows a view of the antenna unit from below.

The four lower conductor elements 32, 34, 36, 38 which are likewise trapezoidal (FIGS. 3 and 5) respectively adjoin the four lateral conductor elements 86, 88, 90, 92. The four lower conductor elements 32, 34, 36, 38 each extend along a direction 112 from the lateral conductor element 86, 88, 90, 92 directly adjoining the respective lower conductor element 32, 34, 36, 38 to the opposite lateral conductor element 86, 88, 90, 92, with the result that the four lower conductor elements 32, 34, 36, 38 are arranged such that they run toward one another in the form of a cross. The four lower conductor elements 32, 34, 36, 38 are each arranged at a distance from one another along the direction 112 of the opposite lower conductor element 32, 34, 36, 38, with the result that a clearance 118 is present in a central region 114 between end regions 116 of the lower conductor elements 32, 34, 36, 38 which face away from the four lateral conductor elements 86, 88, 90, 92. In addition, a width 46 of the lower conductor elements 32, 34, 36, 38 continuously decreases along the direction 112. The four lower conductor elements 32, 34, 36, 38 are also inclined with respect to the emission element 84, a very short distance 120 between the lower conductor elements 32, 34, 36, 38 and a plane of extent of the emission element 84 increasing along the direction 112 (FIG. 4).

The four lower conductor elements 32, 34, 36, 38 comprise the four connecting elements 22, 24, 26, 28 which are each formed by a connecting pin. The four connecting pins extend along a direction 122 which is oriented substantially parallel to the surface normal vector 110 of the emission element 84 and also extends from the emission element 84 to the lower conductor elements 32, 34, 36, 38. The LCR antenna apparatus 14 also has a ground plane element 30 which is oriented parallel to the emission element 84 (FIGS. 3 and 4). The ground plane element 30 is intended to reflect signals or waves emitted by the antenna unit 16 in the direction of the ground plane element 30 and thus to divert the signals or waves in a desirable emission direction. The ground plane element also has four recesses 124 through which the four connecting elements 22, 24, 26, 28 are guided. A distance 40 between the lower conductor elements 32, 34, 36, 38 and the ground plane element 30 increases continuously along a direction 42 from a respective connecting element 22, 24, 26, 28 of the lower conductor element 32, 34, 36, 38 to a region 44 of the conductor elements 32, 34, 36, which faces away from the respective connecting element 22, 24, 26, 28. The four connecting elements 22, 24, 26, 28 are intended to supply a signal, two first connecting elements 22, 26 being associated with the first polarization direction 18 and the two other connecting elements 24, 28 being associated with the second polarization direction 20. The connecting elements 22, 24, 26, 28 associated with a polarization direction 18, 20 are arranged on opposite lower conductor elements 32, 34, 36, 38.

In an alternative refinement of the disclosure, it is also conceivable for the antenna element 16 to also be formed by a stepless, continuously bent sheet metal component, with the result that the individual conductor elements 32, 34, 36, 38, 86, 88, 90, 92 can merge into one another steplessly.

During operation of the LCR antenna apparatus 14, an electromagnetic wave is emitted substantially via the emission element 84, signals being supplied to the emission element 84 via the connecting elements 22, 24, 26, 28, the lower conductor elements 32, 34, 36, 38 and the lateral conductor elements 86, 88, 90, 92. Furthermore, during operation of the LCR antenna apparatus 14 or in an operating mode of the LCR antenna apparatus 14, a differential signal is applied to each of the connecting elements 22, 24, 26, 28 for a polarization direction 18, 20. The two polarization directions 18, 20 each extend between two opposite sides 94 of the emission element 84 and are oriented perpendicular to one another. In order to generate the differential signal, one of the two connecting elements 22, 24, 26, 28 for a polarization direction 18, 20 is supplied with a signal having the same amplitude as a signal supplied to the other connecting element 22, 24, 26, 28 for the same polarization direction 18, 20. The two signals are also phase-shifted through 180° with respect to one another. This results in a potential of zero being applied to one of the planes of symmetry 58, 60 between the two connecting elements 22, 24, 26, 28, the two other connecting elements 22, 24, 26, 28 for the second polarization direction 18, 20 being arranged in this plane of symmetry 58, 60. As a result of this, the signals of the first polarization direction 18, 20 are linearly independent of the signals of the second polarization direction 18, 20.

On account of a linear independence of the signals of the two polarization directions 18, 20, measurement signals 48 are transmitted along one of the two polarization directions 18, 20 and measurement signals 48 reflected by the object 74 or the item being investigated 76 are received along the other polarization direction 18, 20 during operation of the locating device 12. It is also conceivable for circularly or elliptically polarized electromagnetic waves to be emitted during operation by simultaneously supplying signals for the two polarization directions 18, 20, in which case the signals of the two polarization directions 18, 20 must be phase-shifted with respect to one another or have a different amplitude for this purpose. In addition, the antenna unit 16 can be used to emit linearly polarized electromagnetic waves whose polarization plane can assume any desired angle with respect to the two planes of symmetry 58, 60.

On account of the changing distance 40 between the lower conductor elements 32, 34, 36, 38 and the ground plane element 30 and on account of the trapezoidal design of the lower conductor elements 32, 34, 36, 38, a characteristic impedance is continuously changed during operation, for example from 50Ω for components of radio-frequency circuits to 377Ω for a clearance in which the antenna unit 16 emits. In addition, waves emitted by the lower conductor elements 32, 34, 36, 38 are advantageously conducted to the outside between the ground plane element 30 and the lower conductor elements 32, 34, 36, 38 and are then deflected in an emission direction.

The LCR antenna apparatus 14 also has a sheath 52 which surrounds the antenna unit 16, forms a cavity 54 around the antenna unit 16 and is intended to reduce or prevent undesirable lateral emission, which is effected perpendicular to the surface normal vector 110 of the emission element 84, by the antenna unit 16. In this case, the sheath 52 surrounds the antenna unit 16 along a direction 50 which is formed by a circumferential direction and is oriented perpendicular to the surface normal vector 110 of the emission element 84 and around said vector, with the result that the efficiency with which waves or signals are emitted along the surface normal vector 110 of the emission element 84 is increased, the sheath 52 advantageously deflecting or reflecting laterally emitted signals and/or waves in the desired emission direction. In addition, the sheath 52 is arranged around the antenna unit 16 at a distance from the latter. The sheath 52 has a shape 56 or arrangement which is oriented such that it is symmetrical to the two planes of symmetry 58, 60 of the antenna unit 16. The sheath 52 has a plastic base body 126 which has an octagonal cross section and is connected to the antenna unit 16. In addition, the sheath 52 is partially formed from a conductive material and has three induction coils 62 for this purpose which are arranged around the plastic base body 126, the plastic base body 126 being used as a carrier element for the induction coils 62 which thus likewise have an octagonal cross section. The sheath 52 has a height which corresponds substantially to a distance between the emission element 84 and the ground plane element 30 (FIG. 6).

In addition to the antenna unit 16, the induction coils 62 are used to detect objects 74 in the item being investigated 76 by recognizing these objects 74, which are metal objects in particular, as such.

Figure 6:
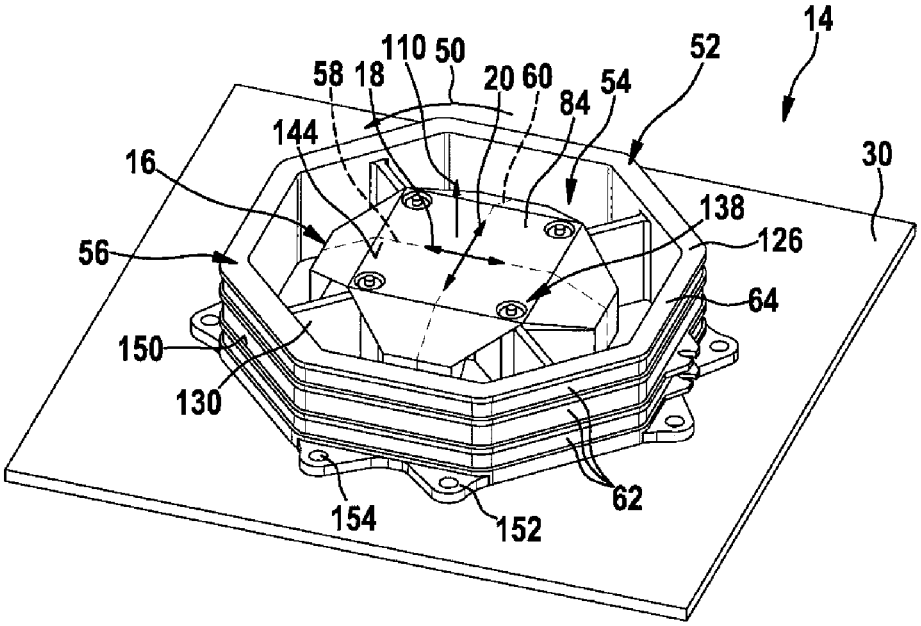
FIG. 6 shows a diagrammatic illustration of the LCR antenna apparatus with a sheath of the antenna unit.
Figure 7:
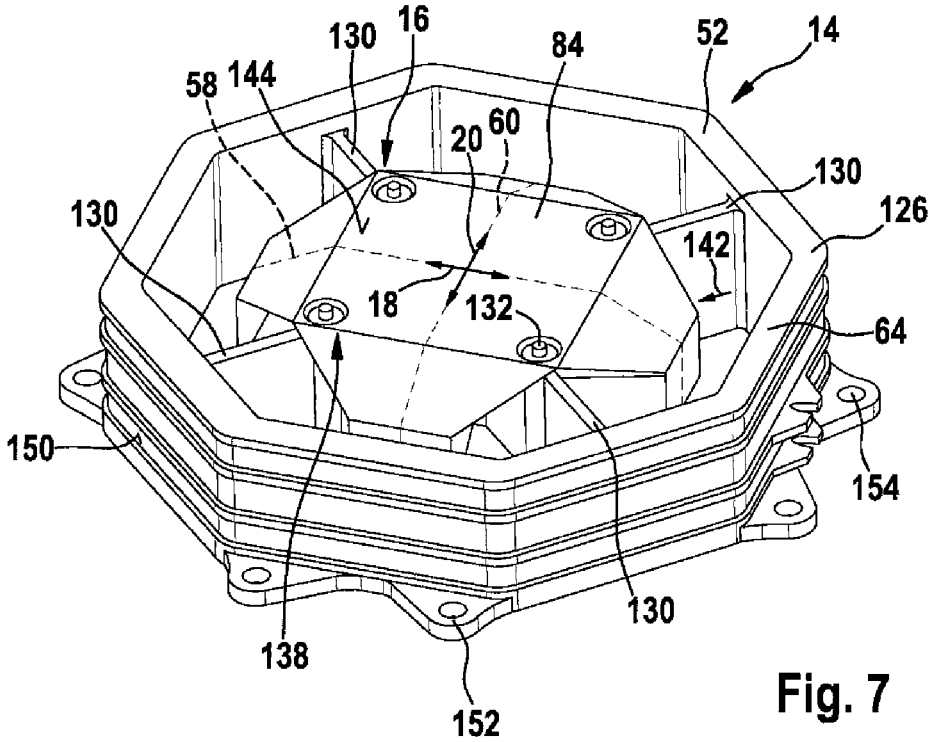
FIG. 7 shows a diagrammatic illustration of the LCR antenna apparatus with a retaining element.
Figure 8:
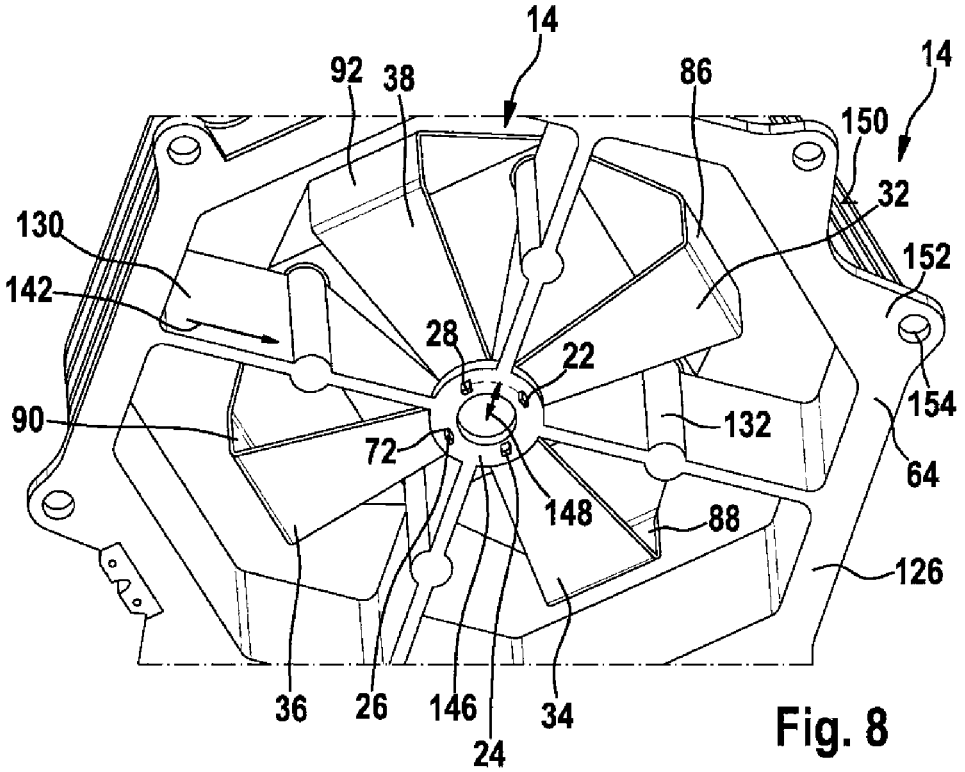
FIG. 8 shows a view of the LCR antenna apparatus with the retaining element from below.

The plastic base body 126 of the sheath 52 is additionally in the form of a retaining element 64 which is intended to fix the LCR antenna apparatus 14 in the locating device 12 (FIGS. 6 to 8). The retaining element 64 is used to arrange the antenna unit 16 at an angle 70 of a plane of symmetry 58, 60 of the antenna unit 16 of 45° with respect to the direction of movement 68 of the guide unit 66 or with respect to a longitudinal axis 128 of the locating device 12 (FIG. 1). As a result, signals or waves advantageously emitted during operation of the locating device 12 can be reflected by an object 74 which is preferably at an angle of substantially 45° with respect to one of the planes of symmetry 58, 60, polarization of the reflected signal being rotated in this case, with the result that signals or waves are emitted along a first polarization direction 18, 20 of the emission element 84 and signals or waves are received along the second polarization direction 18, 20 of the emission element 84.

The retaining element 64 has four retaining struts 130, two retaining struts 130 being arranged such that they run toward one another along a direction 142 from the sheath 52 inward and being oriented in an orthogonal manner with respect to the two other retaining struts 130. The retaining struts 130 have a height which corresponds to a distance between a surface of the emission element 84 which faces the ground plane element 30 and a side of the ground plane element 30 which faces the emission element 84. Each of the retaining struts 130 has a pin 132 which is intended to fix the emission element 84 to the retaining struts 130 (FIGS. 7 and 8). For this purpose, the emission element 84 has four pot-shaped depressions 134 each with a centrally arranged recess 136 on a surface 144 facing away from the ground plane element 30, the recess 136 having a smaller cross section than a cross section of the depression 134 (FIGS. 3, 5 to 7). The depressions 134 are each arranged in a region 138 of the emission element 84 in which no currents flow and impairment of emission can thus be minimized. These regions 138 can be determined using a simulation calculation. These regions 138 are each arranged in an edge region or a corner region along diagonals of the emission element 84. During assembly, the pins 132 of the retaining struts 130 are guided through the recesses 136 in the emission element 84 in order to fix the antenna unit 16 and are then caulked or spaciously pressed with the emission element 84.

In order to guide the connecting elements 22, 24, 26, 28, the retaining element 64 also has a ring element 146 having four recesses 72. The ring element 146 is in the form of a disk and is formed in one part with the four retaining struts 130, with the result that advantageous stability of the retaining struts 130 and fixing of the connecting elements 22, 24, 26, 28 are achieved. The ring element 146 has an average radius 148 which corresponds to half a distance between opposite connecting elements 22, 24, 26, 28. The ring element 146 also allows simple fastening, for example soldering, of the connecting elements 22, 24, 26, 28 to a further component, for example a printed circuit board (FIG. 8).

In order to fasten the retaining element 64, the latter has extensions 152, which are oriented perpendicular to a surface of the sheath 52, on a side 150 facing away from the antenna unit 16. The extensions 152 have recesses 154 which are used to achieve fastening, for example screwing, to further components of the locating device 12 (FIGS. 6 to 8).

Figure 9:
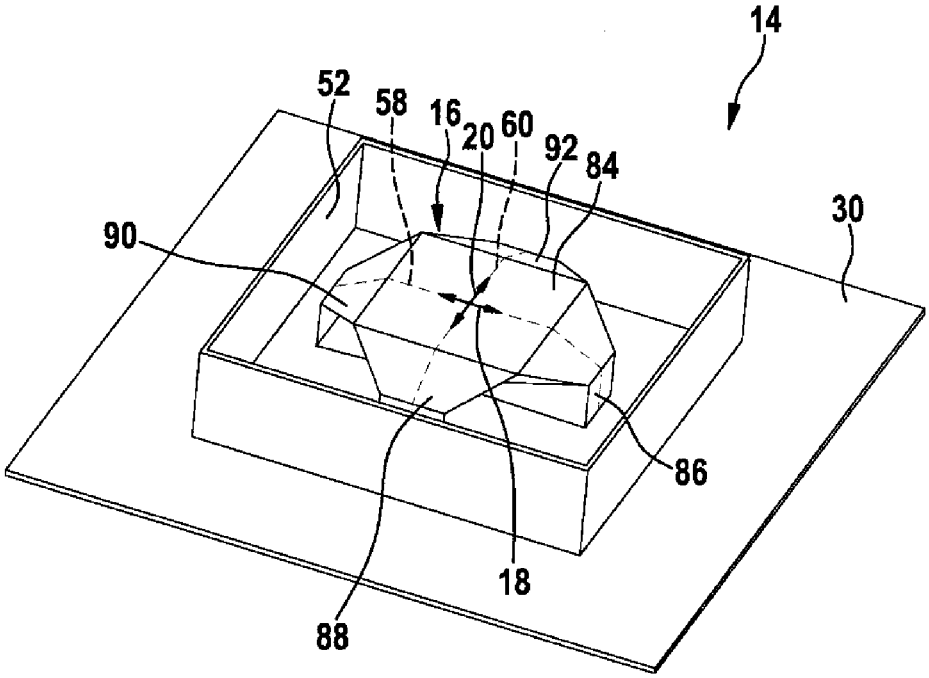
FIG. 9 shows an alternative refinement of the sheath of the antenna unit.

Alternatively, the sheath 52 could be completely formed from a conductive material, as is illustrated in FIG. 9, an alternative embodiment of the LCR antenna apparatus 14. In this case, the sheath 52 is completely formed from a metal material and has a square cross section. In this case, the embodiment of the antenna unit 16 corresponds to an embodiment in FIGS. 1 to 8.

In an alternative refinement, in order to change an emission behavior, in particular an opening angle, of the antenna unit 16, the latter can be provided with a specially shaped dielectric, for example a lens. In addition, in order to reduce a frequency range, the antenna unit 16 can be provided with a dielectric at different locations.

Alternatively, a bandwidth of the antenna unit 16 can also be increased or input matching of the antenna unit 16 can be improved by fitting resistors, for example, to the antenna unit 16 and/or by applying a lossy coating etc., with the result that undesirable currents and/or waves can be absorbed.

The invention claimed is:

1. A locating device, comprising:

a guide unit configured to move the locating device in a direction of movement relative to a surface; and an LCR (large current radiator) antenna apparatus operably associated and moveable with said guide unit, said apparatus including a ground plane element and an antenna unit mounted thereon having a first polarization direction and configured to transmit and/or receive a measurement signal having the first polarization direction, wherein the antenna unit has at least one different second polarization direction for transmitting and/or receiving the measurement signal, the first and second polarization directions defined in a common plane that is parallel to the ground plane element wherein the LCR antenna apparatus has a sheath at least partially formed of an electrically conductive material and configured to surround the antenna unit in at least one polarization direction and to form a cavity surrounding the antenna unit; and wherein the LCR antenna apparatus is arranged relative to the guide unit so that the first and second polarization directions of the antenna unit are each at an angle of approximately 45° with respect to the direction of movement.

2. The device as claimed in claim 1, wherein the first polarization direction is oriented substantially orthogonal to the second polarization direction.

3. The device as claimed in claim 1, wherein the LCR antenna apparatus has at least two first connecting elements, which are configured to feed in a signal of the first polarization direction, and at least two further connecting elements which are configured to feed in a signal of the second polarization direction.

4. The device as claimed in claim 3, wherein one of the connecting elements for one of the polarization directions has a signal applied thereto which has the same amplitude as, but is phase-shifted through 180° with respect to, a signal from the other connecting element for the polarization direction in at least one operating mode.

5. The locating device as claimed in claim 1, wherein:

the antenna unit which comprises the first polarization direction includes two lower conductor elements configured to transmit and/or receive a the measurement signal having the first polarization direction, and a distance between the conductor elements and the ground plane element continuously increases along a direction from a respective connecting element of the conductor elements to a region of the conductor elements which faces away from the respective connecting elements.

6. The device as claimed in claim 5, wherein the two lower conductor elements have a width which increases along the direction.

7. The device as claimed in claim 1, wherein the sheath is at least partially formed by an induction coil configured to surround the antenna unit in at least one polarization direction.

8. The device as claimed in claim 1, wherein the sheath has a shape which is oriented symmetrically to at least one plane of symmetry of the antenna unit.

9. The device as claimed in claim 8, wherein the sheath has an octagonal cross section.

10. The locating device as claimed in claim 1, wherein the LCR antenna apparatus has a retaining element which is configured to fix the antenna unit.

11. The device as claimed in claim 10, further comprising a guide unit with a direction of movement, the retaining element arranging the antenna unit at an angle of a plane of symmetry of the antenna unit of approximately 45° with respect to the direction of movement.

12. The device as claimed in claim 10, wherein the retaining element is configured to accommodate a sheath of the antenna unit.

13. The device as claimed in claim 10, wherein the retaining element has recesses which are configured to guide connecting elements of the antenna unit.

14. The device as claimed in claim 1, wherein the sheath is at least partially formed by an induction coil configured to surround the antenna unit.

* * * * *